US006582237B2

(12) United States Patent
Jacobson

(10) Patent No.: US 6,582,237 B2
(45) Date of Patent: Jun. 24, 2003

(54) ROLLING ELECTRICAL TRANSFER COUPLING IMPROVEMENTS

(76) Inventor: Peter E. Jacobson, 4013 W. Marlette Ave., Phoenix, AZ (US) 85019

( * ) Notice: Subject to any disclaimer, the term of this patent is extended or adjusted under 35 U.S.C. 154(b) by 0 days.

(21) Appl. No.: 10/116,021

(22) Filed: Apr. 3, 2002

(65) Prior Publication Data

US 2002/0111047 A1 Aug. 15, 2002

Related U.S. Application Data

(63) Continuation-in-part of application No. 09/100,207, filed on Jun. 19, 1998.

(51) Int. Cl.[7] ..... H01R 39/00
(52) U.S. Cl. ..... 439/19
(58) Field of Search ..... 439/19, 13–18, 439/20–30

(56) References Cited

U.S. PATENT DOCUMENTS 5,429,508 A * 7/1995 Brevick ..... 439/15
5,829,986 A * 11/1998 Kong ..... 439/19

* cited by examiner

*Primary Examiner*—Gary Paumen
(74) *Attorney, Agent, or Firm*—Devine, Millimet & Branch, P.A.; Paul C. Remus; Todd A. Sullivan

(57) ABSTRACT

The present invention is full-rotational freedom conductor assembly for conducting electricity between a pair of coaxial electrically conductive members. The conductive members are provided with complementary, planar tracks and are relatively rotatable about a common axis thereof. The invention includes a pair or pairs of opposing coupler halves having a planetary axis, with track-adapted profiles. The pairs of coupler halves are rotatably confined between the tracks enabling electrical contact between the tracks of the conductive members. The invention further includes a force source located at least partially between the coupler halves. The force source applies force to each of the coupling halves in a direction substantially parallel to the second common axis. The force is applied to the pairs of coupler halves in a manner that enables the coupler halves to be flexibly retained between the tracks.

15 Claims, 5 Drawing Sheets

ROLLING ELECTRICAL TRANSFER COUPLING IMPROVEMENTS

The present application is a continuation-in-part application, claiming priority from U.S. patent application Ser. No. 09/100,207 filed Jun. 19, 1998.

FIELD OF THE INVENTION

The present invention relates to an electrical connector between relatively rotating elements. More specifically, the present invention is a rolling electrical transfer to improved transfer coupling members between the rotating and the stationary components.

BACKGROUND OF THE INVENTION

The present invention relates to an electrical connector between relatively rotating elements. Electrical equipment such as radar and ship antennas have a need to transmit power and data between stationary equipment and relatively rotating equipment. Electrical connectors that can accommodate constant rotation are needed for these types of applications. Many such electrical connectors exist, but with a variety of deficiencies.

Slip rings have a long history of applications for the transfer of electrical signals and power across a rotating interface. The sliding action between the brush and the ring results in significant drag torque and wear debris. Although a number of improvement patents have been granted for slip rings sets which have improved brush designs such as bundles of conductive fibers, additional improvements are still required. These include an elimination of trades of such parameters as brush pressure and contact area on electrical noise resistance, wear, life, and torque, and sensitivities of brush and ring material on air, fluid and vacuum environments. Maintainability costs related to brush seizure and failure are also excessive.

Rolling electrical conductor assemblies offer performance and life improvements. These concepts, however, are not broadly new and have heretofore been proposed for use in place of the more conventional slip ring and brush assemblies. Early rolling types of conductor assemblies exist, such as those disclosed in U.S. Pat. Nos. 2,467,758 and 3,259,727. U.S. Pat. No. 3,259,727 describes a coil spring coupler design to electrically connect the stationary and the rotary components of the transfer device. This multi-turn spring configuration is more economical to fabricate than a single hoop but imposes increased stress levels for a given preload. A rolling electrical conductor assembly that achieves an economical fabrication benefit without imposing greater stress is needed.

Important improvements have since been developed as disclosed by U.S. Pat. Nos. 4,068,909; 4,098,546; 4,141,139; 4,335,927; 4,372,633 and 4,650,226 which disclose rolling electrical interface configurations for both low level signals and for power. These configurations all use band shaped cylindrical flexible couplers, which are captured in concave grooves in two concentric tracks to electrically connect the rings. The couplers have compliance so as to be preloaded between the two rings. These second-generation transfer configurations provide longer life and near absence of alignment and preload sensitivities, wear debris and rotational torque and greater transfer current capacity. They tend to be relatively expensive to design and manufacture, however, without restricting the potential performance and life benefits. Additional improvements are still required, therefore, to meet the ever-increasing demands of the industry. New improvements are required in rolling electrical transfer components to provide reliable operation for hundreds of millions of bi-directional revolutions without producing significant wear debris, to transfer higher steady-state and surge currents, to eliminate electrical transfer sensitivities to externally induced contaminants and to reduce manufacturing costs.

U.S. Pat. Nos. 5,009,604 and 5,429,508 describe coupler designs for transferring electrical signals between stationary sensors and rotatable steering wheel mounted components such as air bags. One of these coupler designs, which electrically couples the stationary and rotatable component, is of a hoop shape and is rolled out of sheet stock with an over-lapping region. Another uses resilient spheres, which roll in grooved tracks in the stationary and rotational components. The hoop configuration is cost effective and allows thicker material to be used which is advantageous, but tests in grooved tracks have demonstrated a speed limit of only a few hundred RPM because of mechanical discontinuity at the over-lap region. The speed limit is lower in the rotation direction, which causes the over-lap section to advance into the contact interfaces. Debris is generated as the ends of the over-lapped region bi-directionally slide against one another while the radial load moves around the rolling coupler, which reduces its operational life. Examination of couplers after test has identified the source of the speed limit, wear and debris as variations of roundness at the contact diameter and associated preload perturbations during operation. The spherical couplers require multiple components per track, which necessitates the addition of a guide plate assembly, and associated sliding induced component wear.

In all of the listed patents and prior art, the coupler, is predominantly a flexible member, which rides in, and is captured in, the curved tracks in the two conductive members. For those cases where the coupler is not flexible, the fixed and/or rotating members provide the necessary compliance since the coupler is radially preloaded in the tracks. In all of the cited configurations the member-to-member radial annulus space and the radial variations in the track-to-track spacing are accommodated by the radial compliance of the coupler. This rolling deflection results in stress cycling of the coupler as the member and coupler rotates. The configuration is such as to result in more coupler cycles than member rotations. The effect of stress cycling on coupler fatigue life must be carefully considered for each design which must factor in the fatigue characteristics of the coupler material. This requires a knowledge of the material heat treat and process work hardening effects. This information is usually not available at the design stage of the coupler and must be determined by experience.

The roll ring configuration of U.S. Pat. No. 4,372,633 provides increased current transfer capacity by way of increased numbers of couplers, which couple the members. This configuration also uses idlers between the couplers to avoid rubbing friction and wear between adjacent couplers. This configuration also provides guide rails mounted to the inner member to assure that all of the track and coupler interfaces are in rolling contact. The band shaped coupler configuration is costly to fabricate, inspect and plate. Coupler designs that provide the necessary compliance for fitting and preloading between the tracks are thin-walled, hence limiting the transfer current per coupler and the contact areas with the tracks. The contact interfaces exhibit low wear because of the rolling action and the low preload required. Unfortunately, the parameters that lead to low wear also exhibit greater sensitivity to contaminants at the interfaces, which can result in a variation of electrical transfer resistance. This problem specifically affects operations in severe contamination environments such as encountered for helicopter mastheads and tank turrets. The simultaneous requirements of appropriate assembled deflection, current density, contact preload and fatigue life complicates and compromises the design process and results in a flexure wall which is usually thin, on the order of 0.1 mm or so. Additionally, since the coupler walls are thin, it is often not possible to provide proper edge profiles. The operational life and performance is related to this profile. Therefore, it is important to reducing interface sliding and current density to acceptable levels. The thin wall coupler is also difficult and costly to fabricate because of its compliance.

The application of this multi-coupler transfer design is also size limited since the configuration requires that the annulus space between the two concentric rings be filled with a full complement of couplers and idlers. This design is not cost effective because it contains non-utilized current capacity. Improved coupler design configurations are required which have reduced fabrication costs and allow the use of an optimum number of couplers.

U.S. Pat. No. 5,501,604 describes a multi-coupler electromechanical transfer unit design which uses a set of planetary gears to couple a set of planetary rolling preloaded couplers with the rings. In this configuration, the contact rings are coupled to the sun and ring gears of the planetary set. This configuration has the advantage of allowing the use of a greater number of couplers to satisfy a greater transfer current requirement without requiring the use of a full complement. The addition of gearing, however, increases the fabrication cost and decreases the life because of gear wear and the complexity of trying to use a lubricant for the gearing without contaminating the electrical interfaces. In addition, since the couplers ride on a thin compliant tubular carrier which is common to the planet gears, the allowable deflections and misalignments are not as great as that of the early configurations of multi-flexure arrangements such as described in U.S. Pat. Nos. 4,068,909 and 4,372,633.

SUMMARY OF THE INVENTION

The aforementioned difficulties with respect to the transfer of electrical energy between relatively rotatable members are to a great extent alleviated through the practice of the present invention. The present invention provides an electrical conductor assembly having a pair of coaxial conductive members relatively rotatable about a common axis coupled together by pairs of coupler halves, the profile edges of which make contact with matable tracks on the conductive members. Unlike the prior art electrical conductor assemblies which have a flexible coupler preloaded in the track space, the present invention accomplishes the same efficient rolling transfer but without imposing material fatigue design constraints. Additionally, the invention accommodates the use of a selected number of pairs of coupler halves making possible the transfer of increased electrical current by means of a greater number of parallel paths. Unlike the prior art, the inventive coupler halves may be fabricated out of electrically conductive metal sheet stock, which provides enlarged opportunities for optimum material selection. Coupler half-track designs are made possible by the present invention to allow for a variety of contact preloading means and track configurations on the conductive members.

BRIEF DESCRIPTION OF THE DRAWINGS

In the drawings, wherein like reference numbers denote similar elements throughout the several views and embodiments.

DETAILED DESCRIPTION OF THE INVENTION

Figure 1:
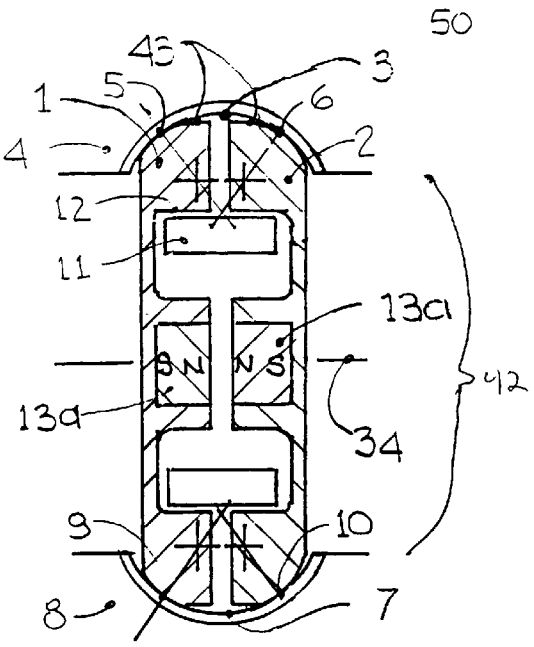
FIG. 1 is a section drawing of one pair of opposing coupler halves fitted into grooved circumferential facing tracks in two conductive members with a passive magnet force source and a radial movement constraint.

A typical embodiment of the improved full-rotational freedom electrical conductor assembly is illustrated in FIG. 1. Two circular coaxial planer electrically conductive members 4 and 8 are relatively rotatable about a first common axis 38. Said members 4 and 8 include tracks 3 and 7, shown in FIG. 1 as transverse circumferential facing radiused tracks. At least one pair of opposing electrically conductive circular coupling halves 1 and 2 are formed with tapered profiles on the outboard edges which effect redundant electrical contact in the annulus space between tracks 3 and 7 at contact points 5 and 6 on conductive member 4 and at contact points 9 and 10 on conductive member 8. A free fitting cylindrical shaped member 11 provides radial constraint of coupling members 1 and 2 by means of radial constraint central cavity 12. A pair of passive magnet force sources 13 and 14 are configured on the opposing surfaces of said coupler halves 1 and 2 respectively said magnets providing a force source which forces said coupling halves away from one another along second common axis 34 said forces causing reliable contact of the tapered profiles of said coupler halves 1 and 2 with said tracks 3 and 7 on said conductive members 4 and 8.

The tapered profiles of each of the coupler halves 1 and 2 maintain contact with the tracks 3 and 7 on the conductive members 4 and 8 during rotating motion even under the influences of geometric imperfections at the contact points 5, 6, 9 and 10. The force source 13 and 14 within the two coupler halves 1 and 2 maintains the tapered profiles on coupler halves 1 and 2 in contact with the tracks 3 and 7 on the conductor members 4 and 8. These contact points 5, 6, 9 and 10 are maintained for both radial and axial space changes between the tracks 3 and 7 on the conductor members 4 and 8.

It is apparent that the pairs of coupler halves 1 and 2 of the present invention are not stress cycled during operation since contact points 5, 6, 9 and 10 at the tracks 3 and 7 on the conductive members 4 and 8 is not maintained by a compliant flexure hoop as is true in the prior art. The design of the coupler halves 1 and 2, therefore, is not sensitive to the influence of fatigue on the coupler design and use. The allowable radial annulus space variation of the coaxial conductive member tracks 3 and 7 is also greater than can be accommodated by flexing coupler designs.

FIG. 1 is one embodiment of the conductor assembly which uses a pair of opposed-pole passive magnets as force source 13 and 14 to provide an optimum, constant, and controllable low level force at the contact points 5, 6, 9 and 10 between the two coupler halves 1 and 2 and transverse radiused tracks 3 and 7 in coaxial conductive members 4 and 8 respectively. A preferred material for the magnets is Samarium Cobalt because of its availability and long-term magnetic stability under a wide range of temperature. A common size for applicable magnets is 3 mm in diameter. A free fitting cylindrical shaped member 11, maintains radial constraint by means of radial constraint cavity 12 within the two coupler halves 1 and 2, but is not always required for small sizes. Test experience has shown that precise alignment of the two coupling halves 1 and 2 is not critical. The coupler halves 1 and 2 may be fabricated on computer-controlled lathes or may be designed to be form stamped out of electrically conductive sheet stock.

Figure 2:
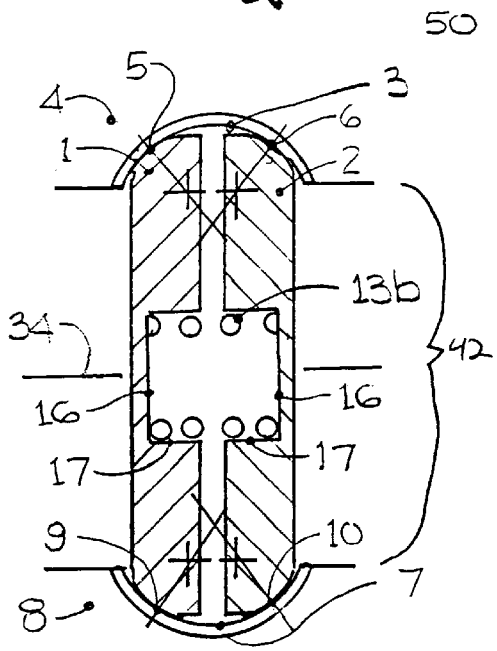
FIG. 2 is similar to the configuration of FIG. 1 but with a compression spring which provides the force source between the two coupler halves.

Another embodiment shown in FIG. 2 uses a coiled spring 15 to provide a force source at coaxial conductor member tracks 3 and 7. The end faces of said spring 15 is a low-level force source against the inner walls 16 of coupler halves 1 and 2. The spring 15 is positioned by radial shoulder 17. This arrangement provides the approximate radial constraint required between the two coupling halves 1 and 2. The spring 15 force source provides all of the advantages of the configuration of FIG. 1 without imposing a magnetic field for those applications where a magnetic field is not acceptable.

Figure 3:
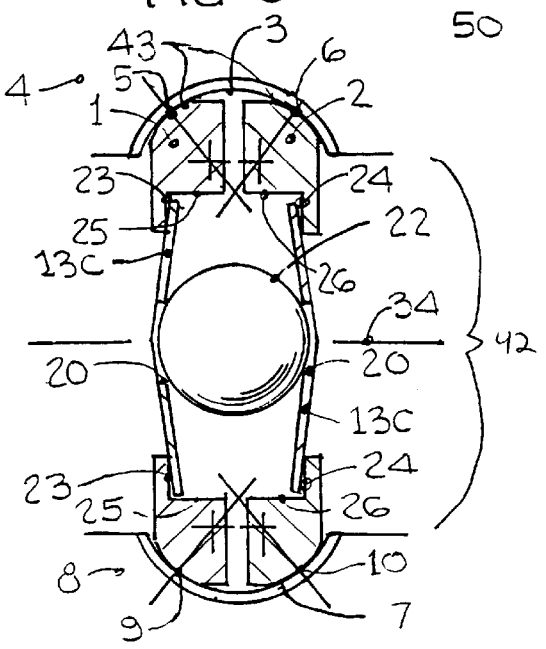
FIG. 3 is a section drawing of one pair of opposing coupler halves fitted into grooved circumferential facing tracks in two conductive members with a compliant diaphragm force source and a non-elastic radial constraint member.

FIG. 3 shows an additional embodiment of the improved conductor assembly which uses a non-elastic ball 22 to preload the coupler members 1 and 2 in to interface contact points 5 and 6 at track 3 in conductor member 4 and into contact points 9 and 10 at track 7 in conductor member 8 respectively, by way of thin resilient diaphragms 18 and 19 attached to coupler halves 1 and 2. The ball 22 is captured by aperture 20 in diaphragm 18 and aperture 21 in diaphragm 19. Diaphragm 18 provides an axial force source on coupler half 1 at surface 25 and on coupler half 2 at surface 24 and are radially aligned by surfaces 25 and 26 respectively. This arrangement captures ball 22 and provides approximate radial constraint of the two coupler halves 1 and 2. The embodiment of FIG. 3 provides an additional cost effective means of reducing production costs of the coupler by reducing the mass of conductive material required for the contact components.

Figure 4:
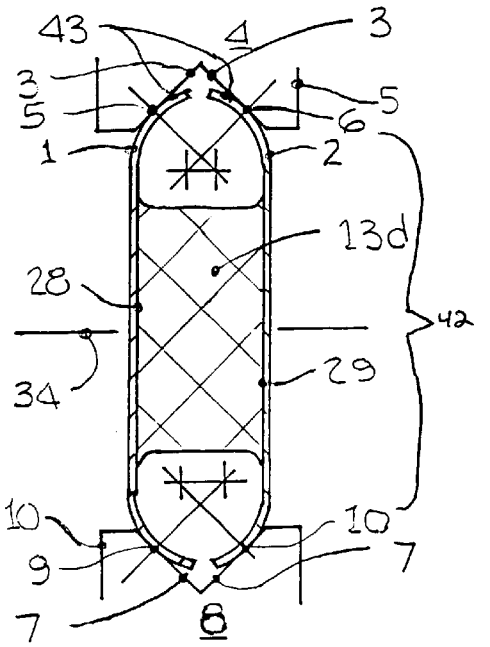
FIG. 4 is a section drawing of one pair of opposing coupler halves formed from sheet stock and fitted into "Vee" grove shaped circumferential facing tracks in two conductive members with an elastic force source.

FIG. 4 is another embodiment of the conductor assembly consisting of coupler halves 1 and 2 formed out of sheet stock and embodies an elastic force member 27 bonded or otherwise connected to coupler halves 1 and 2 at surfaces 28 and 29 respectively. This force source component is at least partially compressed such that an axial force source exists between track 3 in conductor member 4 at contact points 5 and 6 and track 7 in conductor member 8 at contact points 9 and 10. This configuration offers additional cost savings without imposing any life or performance penalties by means of the simplified shape of the coupler halves 1 and 2. Viable materials for the elastic member 27 are micro-porous copolymers and silicon rubber. Bonding of the force member 27 at surfaces 28 and 29 is not always required. Dimpling of coupler halves 1 and 2 can also be utilized to capture the elastic force member 27. Conventional stamping and forming dies are viable means of forming the electrically conductive sheet stock. This offers the advantage of having a larger number of materials to select from during the design process. Examples of materials available predominantly in sheet stock are Molybdenum, copper-clad Molybdenum and Paliney 7 and other alloys produced by the J. M. Ney Company. Molybdenum provides new high temperature capability. Paliney 7 has optimum electrical characteristics. Even though Paliney 7 is expensive, new configurations require minimal material in the sheet form and are, therefore, less expensive to fabricate. In addition, as an additional cost and quality improvement advantage, these and similar materials can be used without plating for acceptable interface contact conductivity.

FIG. 4 also shows an alternate facing "Vee" track configuration for tracks 3 and 7, which can be used with any of the coupler designs. The radiused tracks 3 and 7 shown in FIGS. 1, 2, and 3 are also viable for this coupler. The Vee track is similar to the radiused tracks identified in FIGS. 1, 2, and 3 but with an infinite radius. Alternate combinations of the four configurations shown in FIGS. 1–4 will be obvious to those trained in the art.

Since the material of the coupler halves 1 and 2 may be chosen for electrical properties alone and not for mechanical strength or elastic properties the invention provides important new cost and manufacturability benefits. All of these conductor assemblies are also less sensitive to axial, radial and angular misalignment than slip rings and to radial track space variation than flat band roll ring assemblies.

Figure 5B:
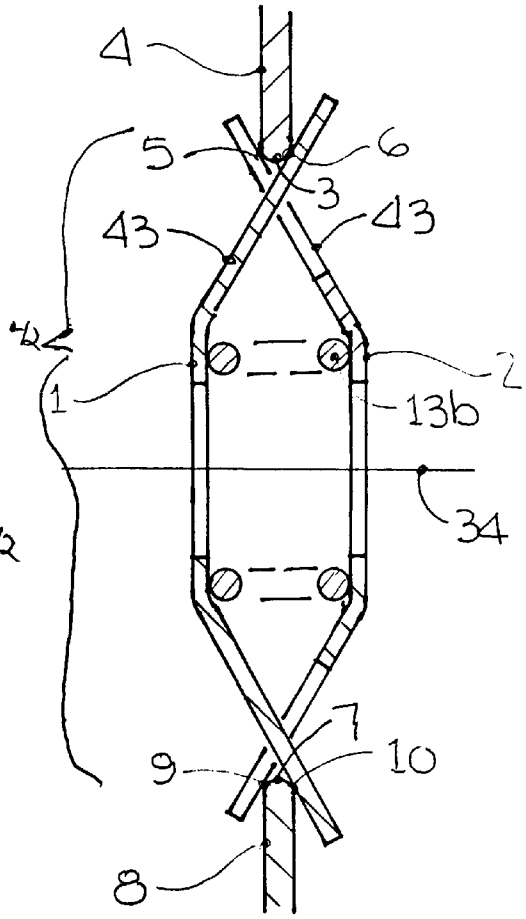
FIG. 5*b* is a diametrical section of the coupler halves and conductive members shown in FIG. 5*a*.
Figure 5A:
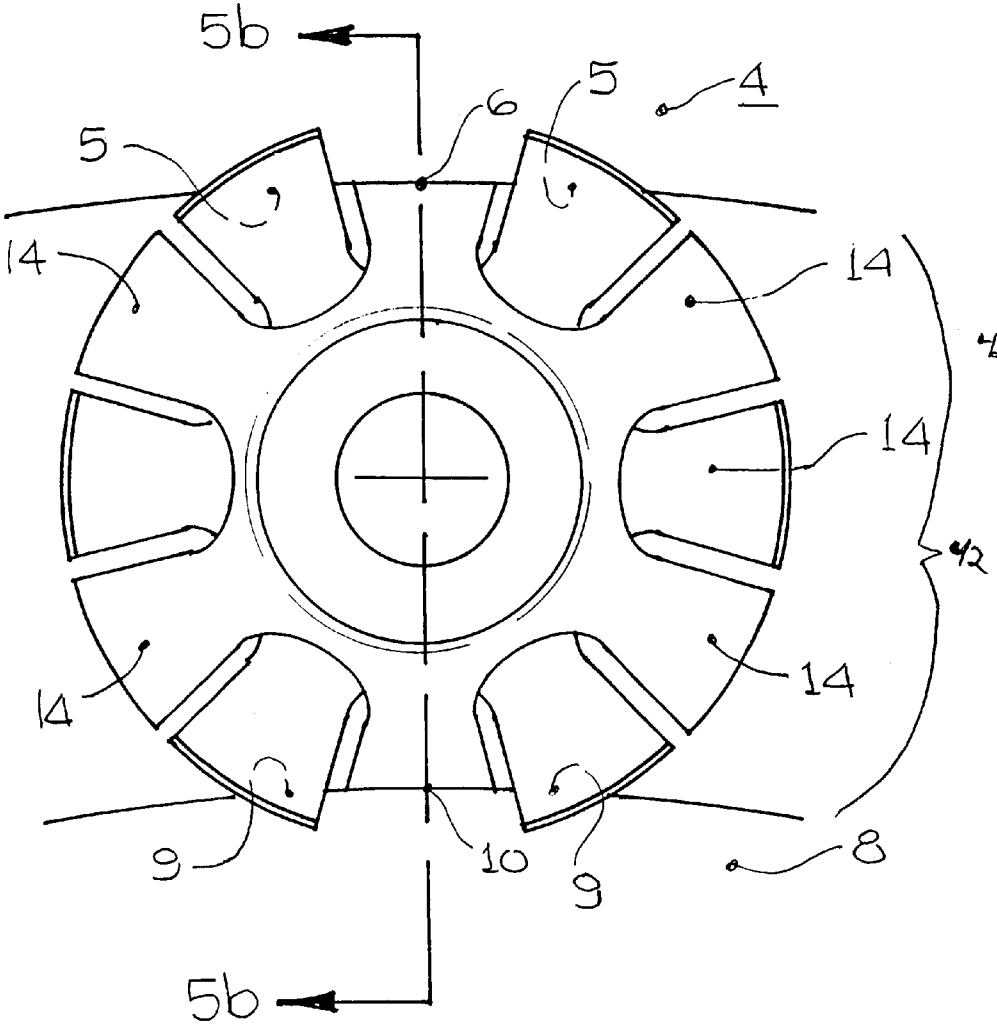
FIG. 5*a* is a plan view of one pair of dished multi-fingered coupler halves with reversed mutual interlacing contact of the fingers on radiused tracks on two coaxial conductive members.

Another embodiment of the inventive coupler, which can be fabricated from stamped and formed conductive sheet material is shown in FIGS. 5*a* and 5*b*. Referring to those figures, tracks 3 and 7 are formed as apertures in coaxial planer conductive members 4 and 8, respectively. The tapered profiles on the two coupling halves 1 and 2 make contact with the contact points 5 and 6 by means of a compression spring 15 force source. Coupler halves 1 and 2 are of a dished multi-finger circular profile with a plurality of contact fingers as shown in FIG. 5*b*. The fingers on a pair of opposed coupler halves 1 and 2 are interleaved and capture said compression spring 15. After assembly into the annulus space between tracks 3 and 7, coupler half 1 is preloaded into contact with conductive member tracks 3 and 7 at contact points 6 and 10 respectively, while coupler half 2 is preloaded into contact with tracks 3 and 7 at contact points 5 and 9, respectively.

In FIGS. 5*a–b*, as conductive member 8 rotates with respect to conductive member 4 about first common axis 38, the pair of dished multi-finger circular coupler halves 1 and 2 also rotates about second common axis 34 and the fingers on said coupler halves 1 and 2 sequentially engage and disengage tracks 3 and 7 assuring a smooth and continuous transfer of electrical energy between the conductive members 3 and 7. It is noted that there are at least three parallel electrical current paths for all angular orientations of the pair of coupler halves 1 and 2, which provides transfer redundancy. It is also noted that the interface geometry may be designed to provide an arc of contact at the contact points, which assures an ability to reduce the interface current density to an acceptable level. The variation of the effective interface contact radii from the rotation center during operation is <2% for a typical design. The small amount of associated sliding action is controlled by design and is ideal for maintaining a clean interface without imposing wear and resultant debris at the low levels of clamping loads. This coupler design permits a larger allowable conductive member track-to-track annulus space variation and permits an associated increase in assembly geometric anomaly of the two conductive members 4 and 8 which provides an additional manufacturing cost benefit. The advantages of this improved conductor assembly concept include reduced total cost, optimum choice of material and increased allowable geometric variation. The previous advantages of long debris free life and low rotational torque are maintained.

Figure 6:
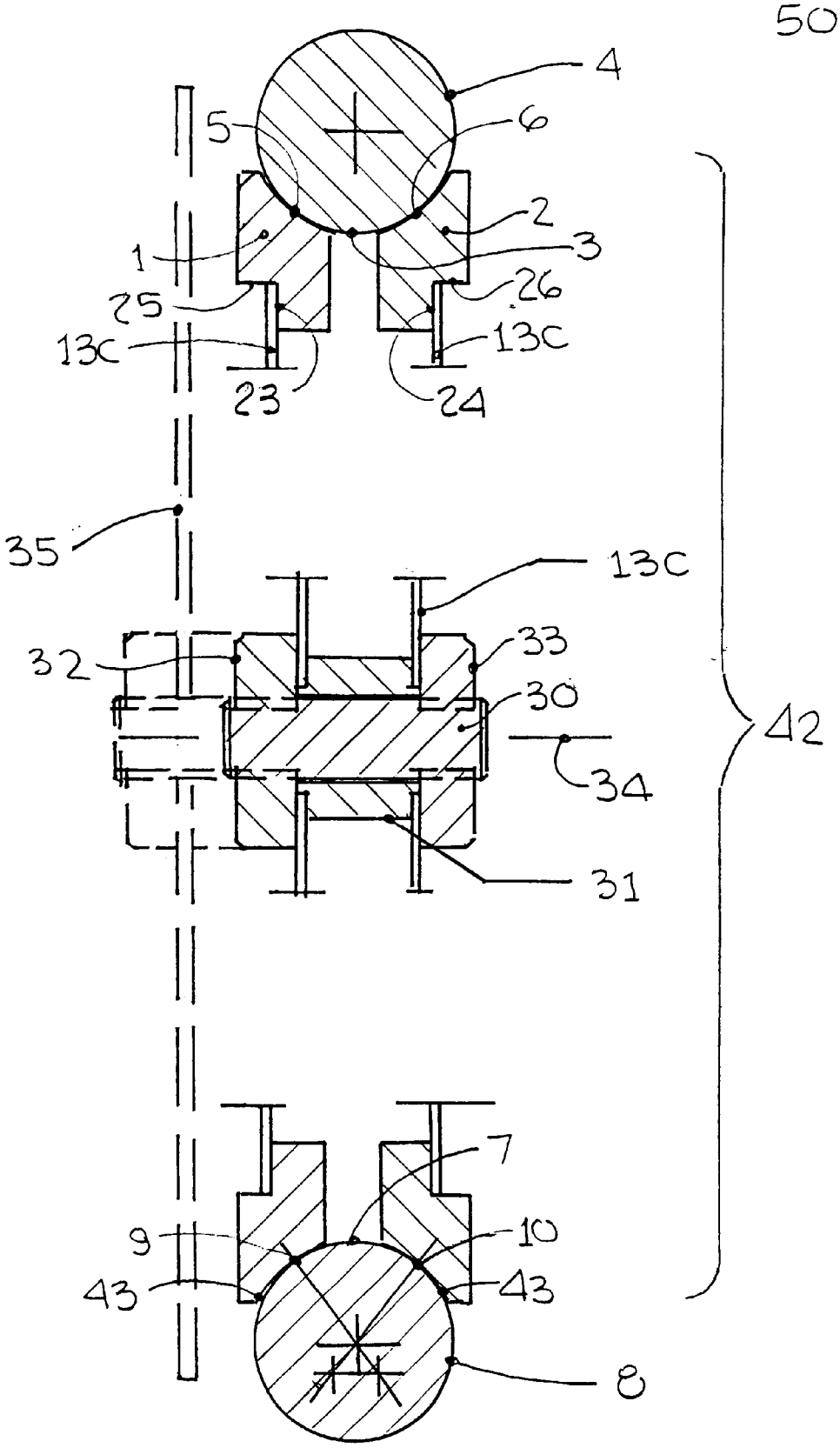
FIG. 6 is a section drawing which shows one pair of coupler halves fitted onto closed loop small rod facing tracks on two coaxial conductive members with a force source consisting of two resilient diaphragms and a high voltage barrier to block line-of-sight electrical coupling with adjacent circuits.

Another embodiment of an improved conductor assembly is shown in the diametrical section of FIG. 6. Referring to the figure, two resilient diaphragms 18 and 19 are deformed so as to provide a mutually attractive force source on faces 23 and 24 of coupler halves 1 and 2 respectively. This force source is applied to two tracks 3 and 7 on conductive members 4 and 8 at contact points 5 and 6 on member 4 and at contact points 9 and 10 on member 8. The contact curvature on coupler halves 1 and 2 are radiused for open conformity with the tracks 3 and 7 on conductive members 4 and 8. A preferred embodiment is to establish coupler member radii in the plane of the view in FIG. 6 to be 20 to 50% greater than that of the radii on tracks 3 and 7. This will assure that the axial and angular alignment requirements between the members 4 and 8 and the coupler halves 1 and 2 are not stringent. The preloading forces imposed by resilient diaphragms 18 and 19 are established by non-elastic force control member 31 on central axle 30 by means of two lock nuts 32 and 33 respectively. The tracks 3 and 7 may be formed from closed loop wire or small rod shapes and captured on insulative forms. Tests of units with track hoop radii of several feet have demonstrated negligible rolling drag torque with significant preloads, as well as an ability to accommodate variations of track-to-track spacing of as much as 7% of the radial annulus span. Unit designs are also viable which have coupler orbit diameters about first common axis 38 of the conductive members 4 and 8 of greater than 30 inches.

Advantages of the coupler configuration of FIG. 6 over prior art are numerous. Since the cycling loads are only related to variations of track spacing and are therefore small, fatigue is not a design driver. Even in those designs that impose large variations of track spacing, the cyclic loading is imposed on the diaphragms 18 and 19. Since the diaphragms 18 and 19 are not in the current transfer path the material may be selected for optimum fatigue strength. Preferred materials for these diaphragms 18 and 19 are Stainless Steel 300 series and Beryllium Copper Alloy 72100. For smaller designs plastic materials may be used for the diaphragms 18 and 19. Since the configuration does not impose expensive forming, machining and plating operations the manufacturing costs are reduced. This configuration has an additional advantage of increased current capacity since the material for the coupler halves 1 and 2 may be selected for optimum conductivity and the contact points 5, 6, 9, and 10 may be designed for minimum current density. This freedom is not available for prior art couplers which must also be designed for mechanical considerations.

Since this embodiment of an improved conductor assembly has potential for application in large transfer assemblies with high voltage requirements, another important feature of the configuration shown in FIG. 6 is a rolling circular line-of-sight high voltage barrier 35, which may be attached to said axle 30 of the pair of coupler halves 1 and 2. A preferred material for this barrier 35 is glass reinforced G-10 plastic which has a dielectric strength of 400 volts/mil. This circular high voltage barrier 35 rolls with the coupler assembly and protects the orbiting coupler halves 1 and 2 from electrical breakdown between adjacent circuits and circuit-to-ground. It is obvious that, although only one barrier 35 is required on each coupler of a set, an additional barrier 35 may be positioned on the opposite side of the coupler if necessary.

Figure 7:
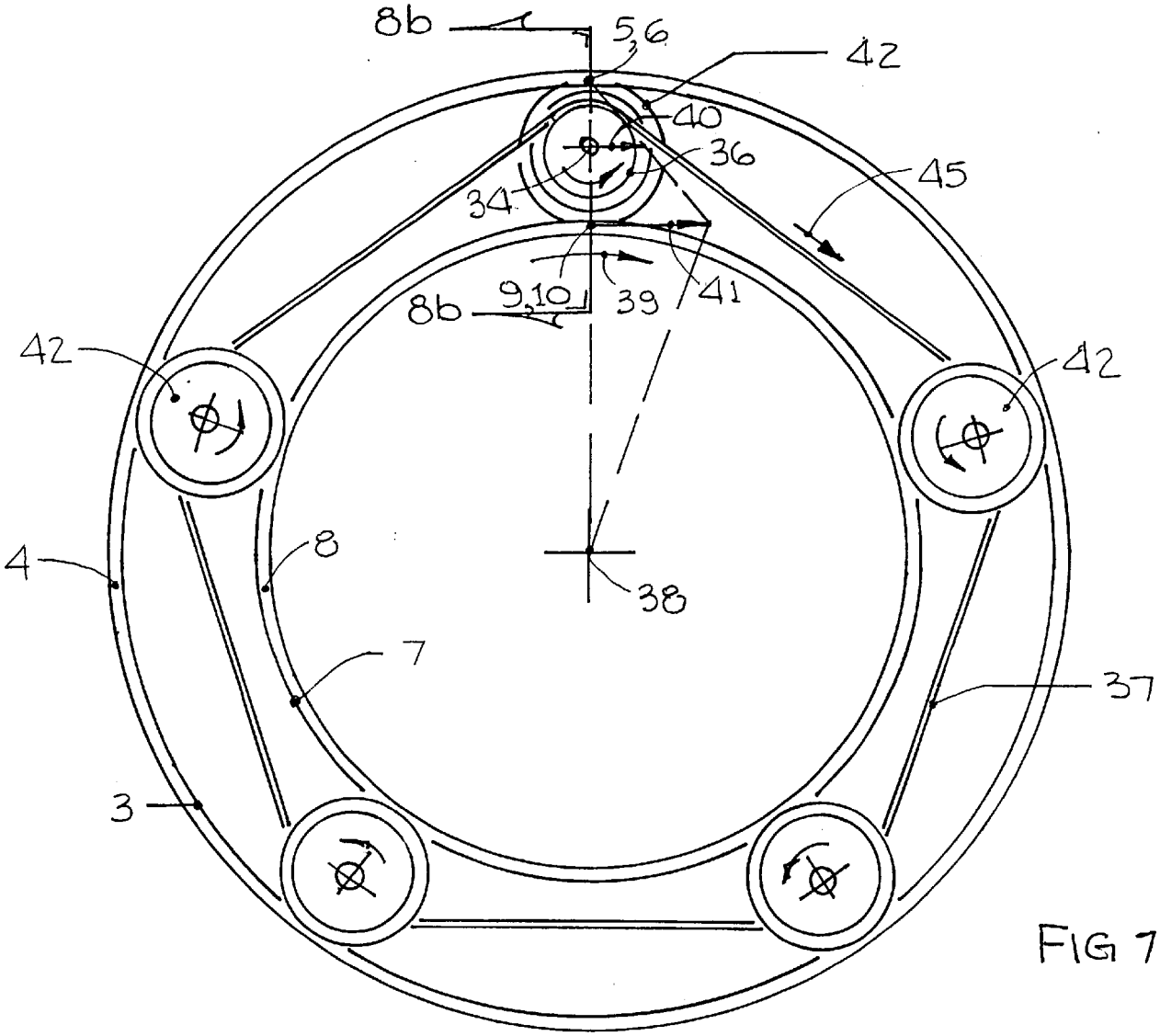
FIG. 7 is a plan view of a conductor assembly with a continuous belt connecting multiple pairs of coupler halves making contact with the tracks on two coaxial conductive members.
Figure 8:
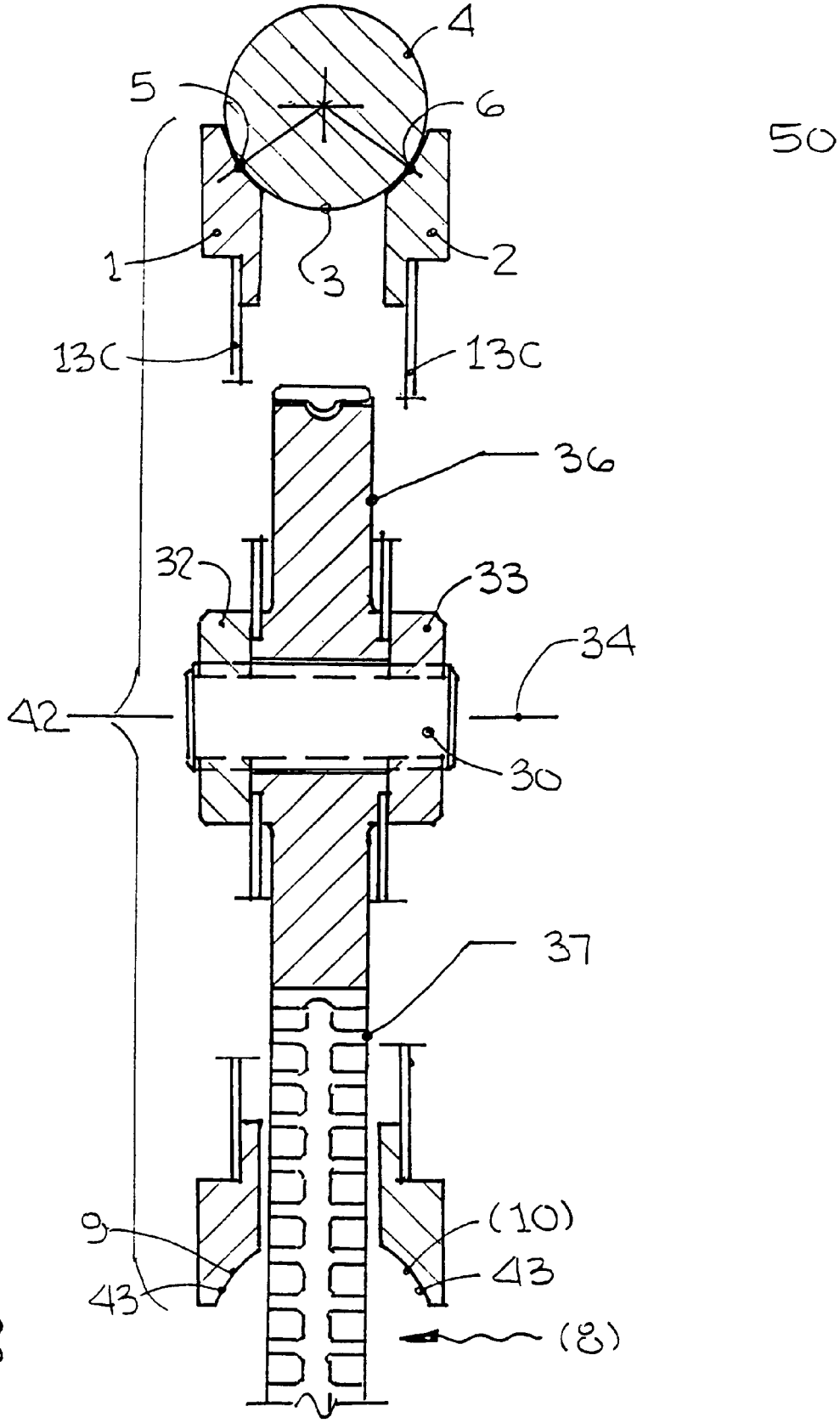
FIG. 8 is a sectional view of one embodiment of the pair of coupler halves making contact with closed loop small rod facing tracks on two conductive members with one track removed to show the position of the control belt and the pulley on which it is mounted.

A high transfer current embodiment of the coupler configuration of FIG. 6 is the configuration shown in FIGS. 7 and 8*b*. Referring to FIG. 7, a plurality of coupler pairs 42 with tapered profiles are captured for making contact with a set of tracks 3 and 7 as described for the configuration of FIG. 6. These said coupler pairs 42 are controlled with a continuous cogged belt 37, which maintains circumferential spacing of said coupler pairs 42. FIG. 8 is a cross-section through one of the coupler pairs 42. The configuration of this coupler pair 42 is identical to that of FIG. 6 with the exception that the non-elastic member 31 of that figure is a non-elastic cogged pulley 36 as shown in FIG. 8, with an identical secondary function to control the deformation of resilient diaphragms 18 and 19 and the resultant force source magnitude. The coupler pairs 42 rotate about second common axes 34 and orbit about conductive member 4 and 8 first common axis 38. Said first common axis 38 is the common center for the tracks 3 and 7. The belt speed represented by velocity vector 41 can be made low by design and is related to the inner ring rotational rate, represented by velocity vector 39, and the tangential velocity represented by velocity vector 41. Since the belt 37 attaches to cogged pulley 36 where the angular velocity vector is in the opposite direction to that of the coupler center 40 said cogged belt 37 velocity 42 is represented by the difference and can be made low. If the cogged belt 37 were attached to cogged pulley 36, which had a diameter the same as the effective track radial separation at the contact points 5, 6, 9, and 10, the belt velocity 41 would be zero. This configuration is not viable, however, because of mechanical constraints and is given to illustrate the potential of decreasing the belt velocity 41 for high-speed applications. This relationship allows the system to be operated at higher speed as well as increase the effective life of the belt 37. Initial assembly and maintenance of the system is enhanced by the fact that the coupler halves 1 and 2 can be easily separated for removal and replacement servicing in mechanisms such as CT scanners. In addition to these advantages, the configuration is cost effective and does not impose any fatigue limitations.

I claim:

1. A full-rotational freedom conductor assembly comprising:

a pair of coaxial electrically conductive members having complementary tracks, relatively rotatable about a common axis;

at least one pair of opposing electrically conductive coupler halves, having a second common axis and located between and engaging the tracks, thereby enabling electrical connection between the tracks of the conductive members; and a force source located at least partially between the coupler halves for applying dynamic force to each of the coupling halves in a direction substantially parallel to the second common axis.

2. The assembly of claim 1 wherein the coupler halves are adapted to fit between transverse radiused tracks.

3. The assembly of claim 1 wherein the coupler halves are adapted to fit between Vee tracks.

4. The assembly of claim 1 further comprising a radial constraint at least partially between at least one pair of the coupler halves, along a direction substantially parallel to the second common axis thereby constraining the force applied by the force source.

5. The conductor assembly of claim 4 wherein the force source is multiple passive magnets wherein at least one magnet is connected to at least one coupler half.

6. The conductor assembly of claim 5 wherein the radial constraint is a free-fitting cylindrical-shaped member captured within a central cavity between the coupler halves.

7. The assembly of claim 1 wherein the force source is at least one coiled spring at least partially compressed between at least one of the pairs of coupler halves.

8. The conductor assembly of claim 1 wherein the force source is at least one elastic member at least partially compressed between, and connected within, at least one of the pairs of coupler halves.

9. The assembly of claim 1 wherein the coupler halves further comprise elastic diaphragms as the force source including an inelastic force control member positioned between the diaphragms.

10. The conductor assembly of claim 9 wherein a high voltage barrier is attached to the non-elastic member thereby eliminating line-of-sight coupling between the coupler halves of at least one of the coupler pairs.

11. The assembly of claim 7 wherein at least one pair of the coupler halves further comprises a dished, multi-finger circular profile for reversed mutual interlacing.

12. The assembly of claim 11 wherein the force source is at least one spring at least partially compressed between at least one of the pairs of coupler halves.

13. The assembly of claim 1 wherein the coupler halves are adapted to fit between at least one of the group consisting of:

closed loop wire; and small rod shapes.

14. The assembly of claim 13 wherein the force source pulls the coupler halves toward one another along the second common axis and the coupler halves straddle the tracks.

15. The assembly of claim 1 further comprising;

at least one cogged belt connecting a plurality of pairs of coupler halves; and a cogged pulley within at least one of said pairs.

* * * * *